US010676677B2

(12) United States Patent
Scandroli

(10) Patent No.: US 10,676,677 B2
(45) Date of Patent: Jun. 9, 2020

(54) SUPPORT SKIRT FOR COKING DRUM

(71) Applicant: AZZ WSI LLC, Fort Worth, TX (US)

(72) Inventor: Tony Scandroli, Cumming, GA (US)

(73) Assignee: AZZ WSI LLC, Fort Worth, TX (US)

( * ) Notice: Subject to any disclaimer, the term of this patent is extended or adjusted under 35 U.S.C. 154(b) by 0 days.

(21) Appl. No.: 16/382,633

(22) Filed: Apr. 12, 2019

(65) Prior Publication Data

US 2020/0040262 A1 Feb. 6, 2020

Related U.S. Application Data

(60) Provisional application No. 62/713,836, filed on Aug. 2, 2018.

(51) Int. Cl.

| | |
|---|---|
| ***C10G 9/18*** | (2006.01) |
| ***C10B 39/06*** | (2006.01) |
| ***C10B 57/08*** | (2006.01) |
| ***C10G 9/00*** | (2006.01) |
| ***C10B 55/00*** | (2006.01) |

(52) U.S. Cl.

CPC ..... *C10G 9/18* (2013.01); *C10B 39/06* (2013.01); *C10B 55/00* (2013.01); *C10B 57/08* (2013.01); *C10G 9/005* (2013.01)

(58) Field of Classification Search

CPC .. C10G 9/005; C10G 9/18; C10B 1/04; C10B 29/04; C10B 29/08; C10B 39/06; C10B 55/00; C10B 57/08; F16J 12/00

See application file for complete search history.

(56) References Cited

U.S. PATENT DOCUMENTS

| | | | |
|---|---|---|---|
| 2,802,596 | A | 8/1957 | Weil |
| 5,804,038 | A | 9/1998 | Nelsen |
| 2003/0131603 | A1 | 7/2003 | Bolender et al. |

FOREIGN PATENT DOCUMENTS

| | | | |
|---|---|---|---|
| CN | 201704279 | U | 1/2011 |
| CN | 204193915 | U | 3/2015 |

OTHER PUBLICATIONS

Cheng, D.H. et al. (1960) Journal of Applied Mechanics, Transactions of the ASME, 27(2), 343-349.*

International Search Report and Written Opinion of counterpart PCT Application No. PCT/US2019/027205 dated Jul. 3, 2019.

Wang; Optimal Design of Coke Drum Skirt Slots; Dept. of Mechanical Engineering University of Alberta; 2017; retrieved from the internet URL: https://era.library.ualberta.ca.

Boswell et al.; Remaining Life Evaluation of Coke Drums; 1997 Energy Engineering Conference; Jan. 29, 1997; retrieved form the internet URL: http://www.boswellfarms.com/.

* cited by examiner

*Primary Examiner* — Brian A McCaig

(74) *Attorney, Agent, or Firm* — Chambliss, Bahner & Stophel, P.C.

(57) ABSTRACT

An apparatus for improving thermal-mechanical stress resistance in a delayed coking drum having a drum shell. The apparatus includes a support skirt section configured to mount to and to assist in supporting the coking drum above a ground surface. A joining edge joins the support skirt section to an exterior portion of the drum shell. A T-shaped slot is formed in the support skirt section and is located proximate the joining edge. The T-shaped slot may be formed by a vertical slot portion and a horizontal slot portion joined together as a single slot.

19 Claims, 5 Drawing Sheets

SUPPORT SKIRT FOR COKING DRUM

CROSS-REFERENCE TO RELATED APPLICATIONS

This application claims the benefit of U.S. Provisional Patent Application No. 62/713,836, filed on Aug. 2, 2018, and entitled IMPROVED SUPPORT SKIRT FOR COKING DRUM, which is incorporated herein by reference in its entirety.

FIELD

This invention relates to delayed coking. More particularly, this invention relates to a method and apparatus for reducing the stresses in delayed coking drum support skirts that result from thermal-mechanical loading during the coking cycle.

BACKGROUND

Delayed coking is a process that is commonly used in the petroleum refining industry for converting or upgrading heavy residual oils to lighter distillate products and coke. In delayed coking, the heavy residual oil is initially heated in a furnace to a temperature at which thermal cracking begins. In the "charging" phase of the process, the heated feed is directed from the furnace into a large coking drum, whereupon the cracking proceeds over an extended period of time. The cracking process results in the production of hydrocarbons that are lighter (i.e., have a lower molecular weight than the feed) and are in vapor form. These vapors rise to the top of the coking drum and are led off to a downstream product recovery unit. During the thermal cracking of the feed, coke is also produced and is gradually accumulated inside of the coking drum. Once the level of coke within the coking drum has reached a predetermined limit, the introduction of the new feed into the coking drum ceases. Any vaporous products that remain in the coking drum at that point are purged from the coking drum using steam. After that purging process, the built-up coke is quenched with water. The coke inside the coking drum is then broken up, typically using hydraulic jetting or cutting with high pressure water jets. The lower end of the coking drum is then opened and the broken-up coke is discharged from the coking drum via a bottom chute. At that point, the coking drum and its various components may be further processed (e.g., rinsed), etc. and the delayed coking process will be repeated.

With initial reference to FIG. 1, a portion of a typical coking drum 100 (or simply "drum") of the type used in the delayed coking process is shown. The drum 100 is a large vessel that is often 3-10+m in diameter and 10-30+m tall. The drum 100 includes an outer shell that is typically made of unlined or clad steel and that ranges from about 10 to 30 mm thick. The outer shell includes an upper cylinder portion 102 and a lower frusto-conical portion 104 that terminates in a lower cylindrical section 105 having a smaller diameter. The cylindrical section 105 of the lower portion 104 of the shell is typically closed off by a bottom closure disk 106 or, alternatively, a mechanical valve. During the discharge process discussed previously, this closure disc 106 is opened to enable broken-up coke to flow out of the drum 100. The drum 100 is often supported over a ground surface G by a support skirt 108 that is mounted to a lower exterior portion of the shell. In this particular case, as illustrated in the detail portion of FIG. 1, a weld 110 joins the top end of the support skirt 108 with the bottom of the upper cylindrical portion 102 of the drum shell.

In most delayed coking operations, coking drums operate together in pairs and in alternating fashion in order to provide a semi-batch process. Each pair of coking drums sequentially proceeds through the charge-quench-discharge cycle outlined above. Thus, while one coking drum is being charged with heated feed, the other is quenched and discharged in a semi-continuous process. This results in each coking drum being heated and cooled repeatedly. This repeated heating and cooling causes high metal stresses to develop in the area of the junction between the drum 100 and its support skirt 108. This occurs, for example, when quench water is introduced into the drum to quench the coke. When the quench water is introduced, the drum exterior is much hotter than the quench water inside the drum, and the temperature differential between the drum interior and the drum exterior results in large thermal gradients. These thermal gradients cause high metal stresses. As a result, the skirt-to-shell junction weld 110 and adjacent areas are susceptible to fatigue failure due to the severe thermal-mechanical cyclic stresses. Cracks often develop in the area where the support skirt 108 is attached to the drum 100. In certain severe cases, the drum 100 separates entirely from the support skirt 108 as a result of these cracks, resulting in a very dangerous condition.

One early industry practice for addressing this problem was to reduce the local stiffness and stresses close to the skirt-to-shell junction weld 110. This could be accomplished, for example, by placing simple vertical slots in the support skirt 108. The earliest version of these vertical slots had squared-off ends that terminated without any special geometry and that were simple to machine. These slots were found to provide a modest improvement to the life and performance of the skirt attachment. Later, as depicted in FIGS. 2 and 3, these simple slots were replaced with slots 112 having a larger diameter hole (also called a keyhole 114) at each end of the slot. These slots 112 and keyholes 114 were found to further reduce the local stiffness and stresses close to the skirt-to-shell junction weld 110. However, both of these methods have had only moderate success. In one example, the results from a finite element analysis of a support skirt having this type of traditional slot indicated a useful life of less than 1.8 years. While the useful life in other cases will vary, a longer useful life than that provided by conventional slots 112 and the like is desired.

Accordingly, what is needed, is a method and apparatus that improves the resistance to fatigue cracking due to the thermal-mechanical cyclic stresses in a skirt-to-shell junction of a coking drum.

NOTES ON CONSTRUCTION

The use of the terms "a", "an", "the" and similar terms in the context of describing embodiments of the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

The term "section" could include a portion of a support skirt having a T-shaped slot disclosed herein. The term "section" could also be an entire support skirt having a T-shaped slot.

SUMMARY

The above and other needs are met by an apparatus for improving thermal-mechanical stress resistance in a delayed coking drum having a drum shell. The apparatus includes a support skirt section configured to mount to and to assist in supporting the coking drum above a ground surface. A joining edge joins the support skirt section to an exterior portion of the drum shell. A T-shaped slot is formed in the support skirt section and is located proximate the joining edge. The T-shaped slot may be formed by a vertical slot portion and a horizontal slot portion joined together as a single slot. In certain embodiments, a vertical height H of the slot is greater than a horizontal width W of the slot.

In some cases, the T-shaped slot is formed by a vertical slot portion having a vertical section formed by sides and a first horizontal slot portion having left and right ends that are separated by a horizontal section. In that case, the horizontal section includes left and right first horizontal faces joined by shoulders to the sides of the vertical section. Also, a second horizontal face is located opposite the first horizontal faces. The vertical section of the vertical slot portion may be centered between the left and right ends of the first horizontal slot portion. In certain embodiments, a second horizontal slot is joined to the vertical straight portion of the vertical slot opposite the first horizontal slot.

In some embodiments, at least one of the left and right ends of the first horizontal slot portion is curved. In other cases, both the left and right ends of the first horizontal slot portion are curved. In some cases, the vertical section of the vertical slot portion that is located opposite the first horizontal slot portion is curved. In some cases, both of the left and right first horizontal faces are flat. In certain embodiments, the second horizontal face is flat. In other embodiments, the second horizontal face is curved. According to certain embodiments, a plurality of T-shaped slots is spaced laterally across the support skirt section, such that the plurality of T-shaped slots surround at least a portion of the coking drum when the support skirt is mounted to the drum shell.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 4:
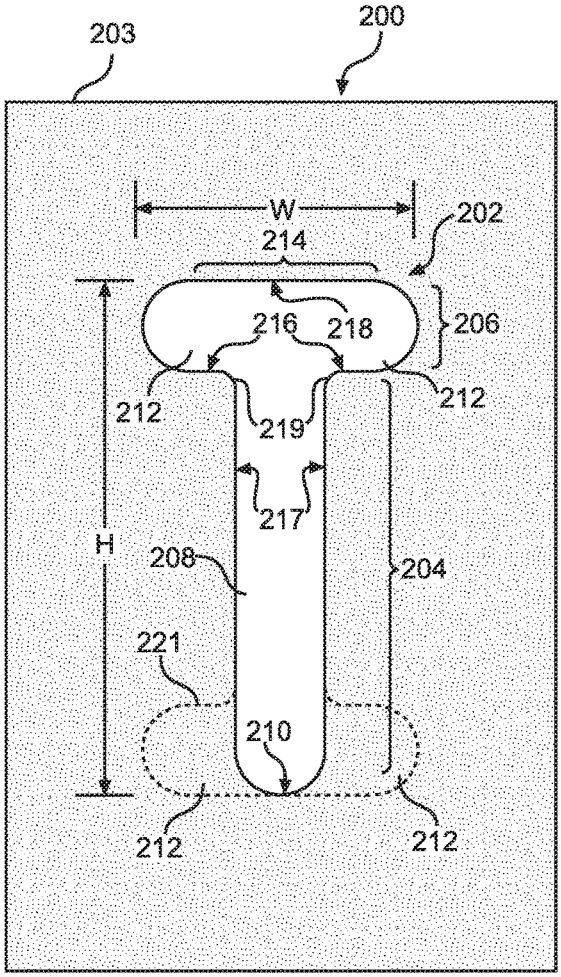
FIG. 4 is a front elevation view of a support skirt section having an T-shaped slot according to a first embodiment of the present invention.
Figure 5:
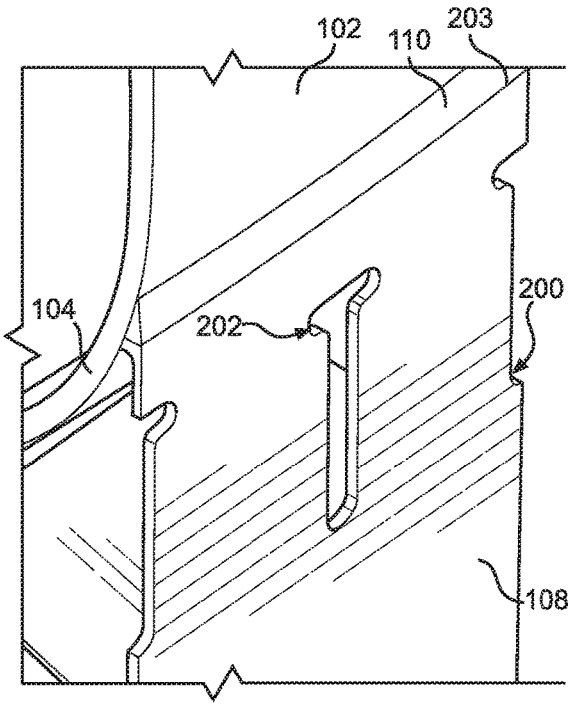
FIG. 5 is a perspective view depicting the support skirt section in FIG. 4 mounted to a coking drum.

With reference now to FIGS. 4 and 5, there is provided an apparatus for redistributing and lowering the stresses resulting from thermal-mechanical loading and improving resistance to cracking due to thermal-mechanical stresses in a delayed coking drum having a drum shell according to a first embodiment of the present invention. Depicted is a support skirt section 200 provided with a slot 202 that resembles a capitalized "T" and that is mounted to or formed as part of a support skirt 108. A joining edge 203, located near the top portion of the support skirt section 200, is connected via weld 110 to the upper cylindrical portion 102 of a coking drum. The support skirt section 200 may be mounted to either the upper cylinder portion 102 or the lower frusto-conical portion 104. Support skirt section 200 provides the skirt 108 and, more importantly, the skirt-to-shell junction weld 110 with improved thermal-mechanical stress resistance. As detailed further below, the support skirt section 200 may form part of or an entire support skirt, and it may be mounted to a drum shell as part of a new installation or as part of a retrofit to an existing support skirt.

The slot 202 is formed by a vertical slot portion 204 that is joined together with a first horizontal slot portion 206. The vertical slot portion 204 includes a vertical section 208 that terminates at an end 210. The first horizontal slot portion 206 includes opposing left and right ends 212. In contrast with the circular keyholes 114 discussed previously, the left and right ends 212 of slot portion 206 are separated by a horizontal section 214 located between them (in order to form an elongated capsule-shaped keyhole versus the circular keyhole described in the prior art). To ensure its capsule shape, the vertical height of the first horizontal slot portion 206 is less than the horizontal width of the first horizontal slot portion. The horizontal section 214 includes first horizontal faces 216 that are adjacent the left and right sides of the vertical section 208. In this particular embodiment, the left and right first horizontal faces 216 provide flat bottom portions to the horizontal section 114 and are joined to sides 217 of the vertical section via rounded shoulders 219. In preferred embodiments, shoulders 219 are rounded to smooth the transition between the vertical slot portion 204 and the horizontal slot portion 206. The horizontal section 214 also includes a second horizontal face 218 that forms a flat top portion of the horizontal section and is located opposite the first horizontal faces 216.

Preferably, the vertical slot portion 204 extends downwards from the center of the first horizontal slot portion 206 such that it is centered between the left and right ends 212. However, in other embodiments, the vertical slot portion 204 may be offset left or right to any position along the length of horizontal slot portion 206 (including all the way to either of the ends 212). In other embodiments, the vertical slot portion 204 may extend upwards from the second horizontal face 218 of the first horizontal slot 206 (i.e., an upside down "T" shape). In some embodiments, the slot 202 may resemble a capitalized "I" or the profile of an I-beam. In that case, a second horizontal slot 221 replaces the closed end 210 of the vertical section 208 of the vertical slot portion 204 (as shown by dashed lines in FIG. 4).

In preferred embodiments, the end 210 of the vertical slot portion 204 is rounded or curved in order to eliminate sharp corners and in order to minimize the concentration of stress at that point of the slot 202. Similarly, the left and right ends 212 of the horizontal slot portion 206 are rounded or curved in order to minimize the stress concentration at these locations as well. Minimizing stress concentration in these various locations improves the slot's 202 resistance to cracking under thermal-mechanical stress. Rounding the ends is an improvement over the simple squared-off ends of earlier rectangular slot designs. However, notwithstanding the rounded ends of both the vertical and horizontal slot portions 204, 206, experimental results showed that stress-induced cracks were sometimes initiated at both ends 212 of the first horizontal slot portion 206.

Figure 6:
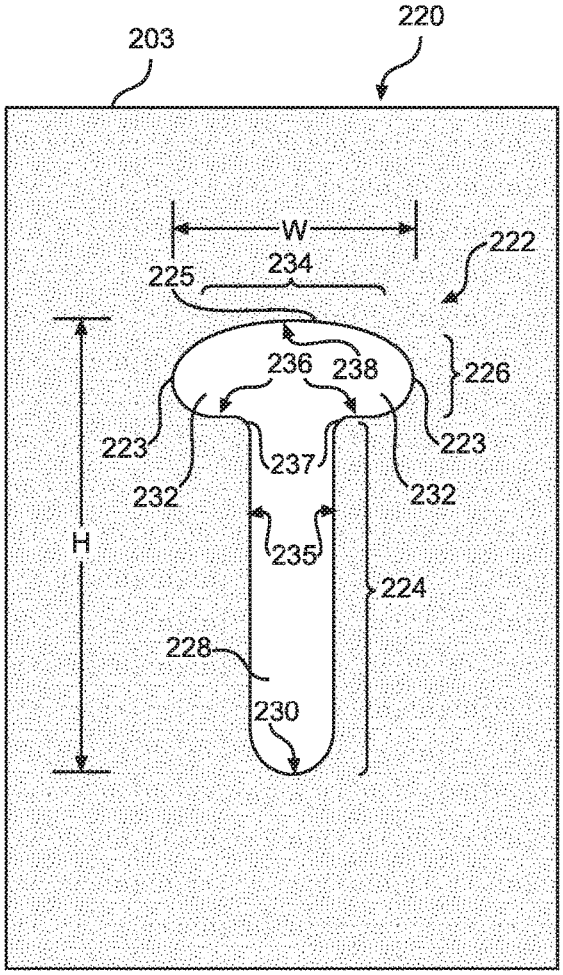
FIG. 6 is a front elevation view of a support skirt section having an T-shaped slot according to an alternative embodiment of the present invention.
Figure 7:
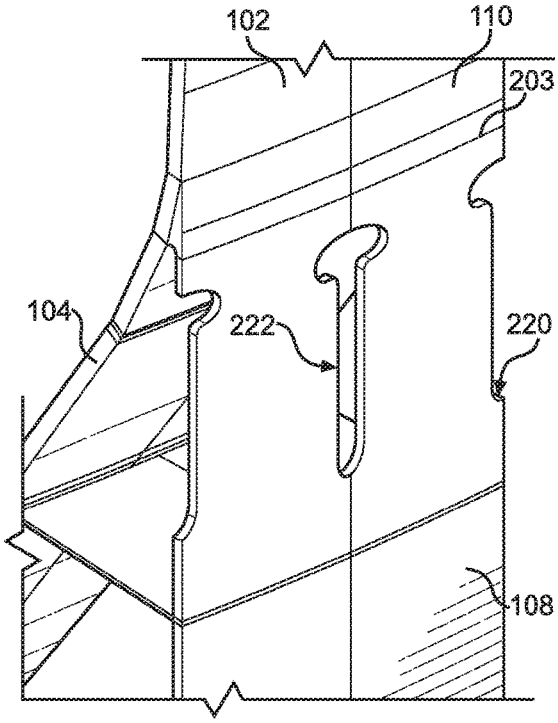
FIG. 7 is a perspective view depicting the support skirt section in FIG. 6 mounted to a coking drum.

Thus, with reference to FIGS. 6 and 7, an alternative design of a support skirt section 220 with improved resistance to thermal-mechanical stress is disclosed. The alternative support skirt section 220 closely resembles support skirt section 200. Like support skirt section 200, alternative support skirt section 220 includes a slot 222 that resembles a capitalized "T", which slot is formed by a vertical slot portion 224 that is joined together with a first horizontal slot portion 226. The vertical slot portion 224 includes a vertical section 228 that terminates at an end 230. The first horizontal slot portion 226 includes opposing left and right ends 232. The left and right ends 232 of slot portion 226 are separated by a horizontal section 234 located between them. The horizontal section 234 includes left and right first horizontal faces 236, which are joined to sides 235 of the vertical section 228 of the vertical slot portion 224 by shoulders 237. Additionally, the horizontal section 234 also includes a second upper face 238 that is located opposite the first horizontal faces 236.

However, unlike slot 202, the second upper face 238 of slot 222 is not flat. Instead, the upper face 238 is provided with a curved surface, which has been found to further improve the support skirt section's 220 resistance to cyclic stresses. Preferably, the upper face 238 is continuous with the curved left and right ends 232, such that there are no sharp corners, transitions, etc. along at least the top surface of the first horizontal slot portion 226. It has been found that by providing this continuous curve, stress-induced cracks are less likely to form at the rounded tangent points 223 at ends 232; rather, stress-induced cracking is more likely to begin at just a single initiation site 225 located at the center of the second upper face 238. In some embodiments, the first horizontal faces 236 may also be curved as well in order to further extend the continuously curved surface discussed above. However, to ensure its capsule shape, the vertical height of the first horizontal slot portion 226 is less than the horizontal width of the first horizontal slot portion.

Slot 222 (and slot 202) has a height H and a width W. In certain cases, the height H and width W are equal to one another. However, more preferably, in order to more closely approximate the "T" shape, the height of vertical slot portion 224 is greater than the width of the first horizontal slot portion 226, and height H is greater than width W. For example, in the embodiment shown in FIG. 4, the slot 202 has a height H equal to about 16 inches and a width W equal to about 6 inches. In the embodiment shown in FIG. 6, slot 222 is slightly taller due to the upwardly rounded second upper face 238 and has a height H equal to about 16.47 inches and a width W equal to about 6 inches.

Thus, according to the present invention, the traditional slot 112 and keyhole 114 often found in prior art support skirts are replaced with T-shaped (or I-shaped) slot 202 or slot 222. It has been found that replacing the vertical slots 112, including those with or without a keyhole 114, with T-shaped slot 202 or slot 222 results in a significant reduction in thermal-mechanical cyclic stresses proximate the skirt-to-shell junction weld 110 of the coking drum and a significant improvement to the life of the weld. Experimental finite element analysis of traditional support skirts having conventional stress relief designs, such as the slot 112 and keyhole 114 features, resulted in a useful life of less than 1.8 years. Somewhat unexpectedly, use of the T-shaped slot 202 of the present invention resulted in a substantial increase to the useful life of a support skirt. In some cases, the useful life was doubled when the T-shaped slot was used. In other cases, the useful life of the support skirt was extended by a factor of 5 or more by using the presently-disclosed T-shaped slot design.

Figure 8:
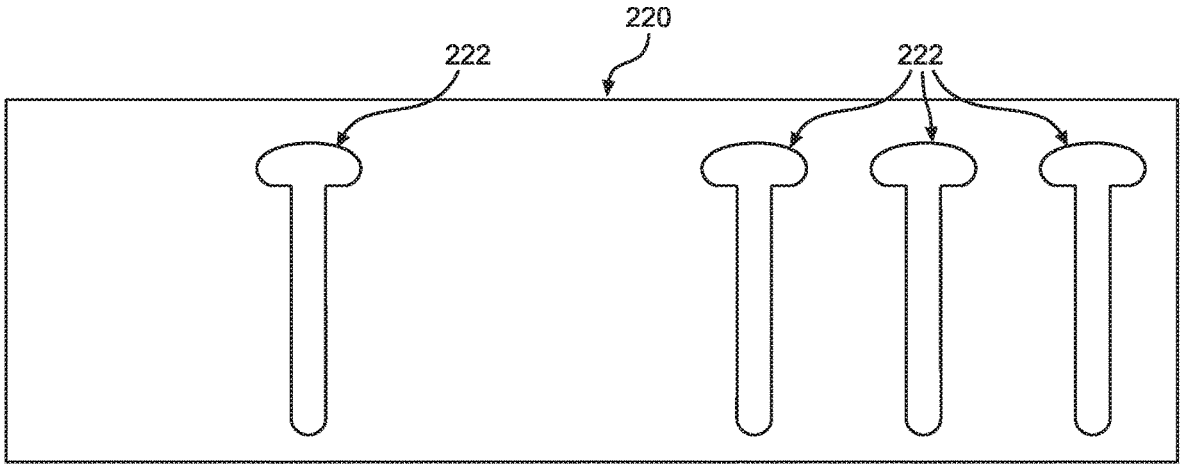
FIG. 8 is a front view of a support skirt section having a plurality of T-shaped slots formed therein.

With reference now to FIG. 8, one or more of the T-shaped slots 222 (or slots 202) discussed herein may be formed in a single support skirt section 220 in spaced apart relation. The exact dimensions and spacing of the slots 222 vary from one coking drum to the next due to different operating conditions, materials of construction, skirt-to-shell attachment configuration, etc. Sizing and dimensions may be optimized according to known methods as needed, including, for example, by performing an iterative stress analysis using finite element analysis techniques. This analysis takes several factors into consideration, including skirt thickness, slot dimensions, and slot spacing, in order to minimize the stress concentration at the top and ends of the slot, thus maximizing the life of the slot 222 before cracks start to appear due to thermal-mechanical loading of the coking drum during its operating cycle. Varying these factors varies the characteristics of the support skirt section 220 and often have a direct impact on the stress levels at the slot locations and impact the life of the slot 222. In addition to affecting the life of the drum skirt from slot dimensional changes, structural stability of the coking drum needs to be considered.

Figure 1:
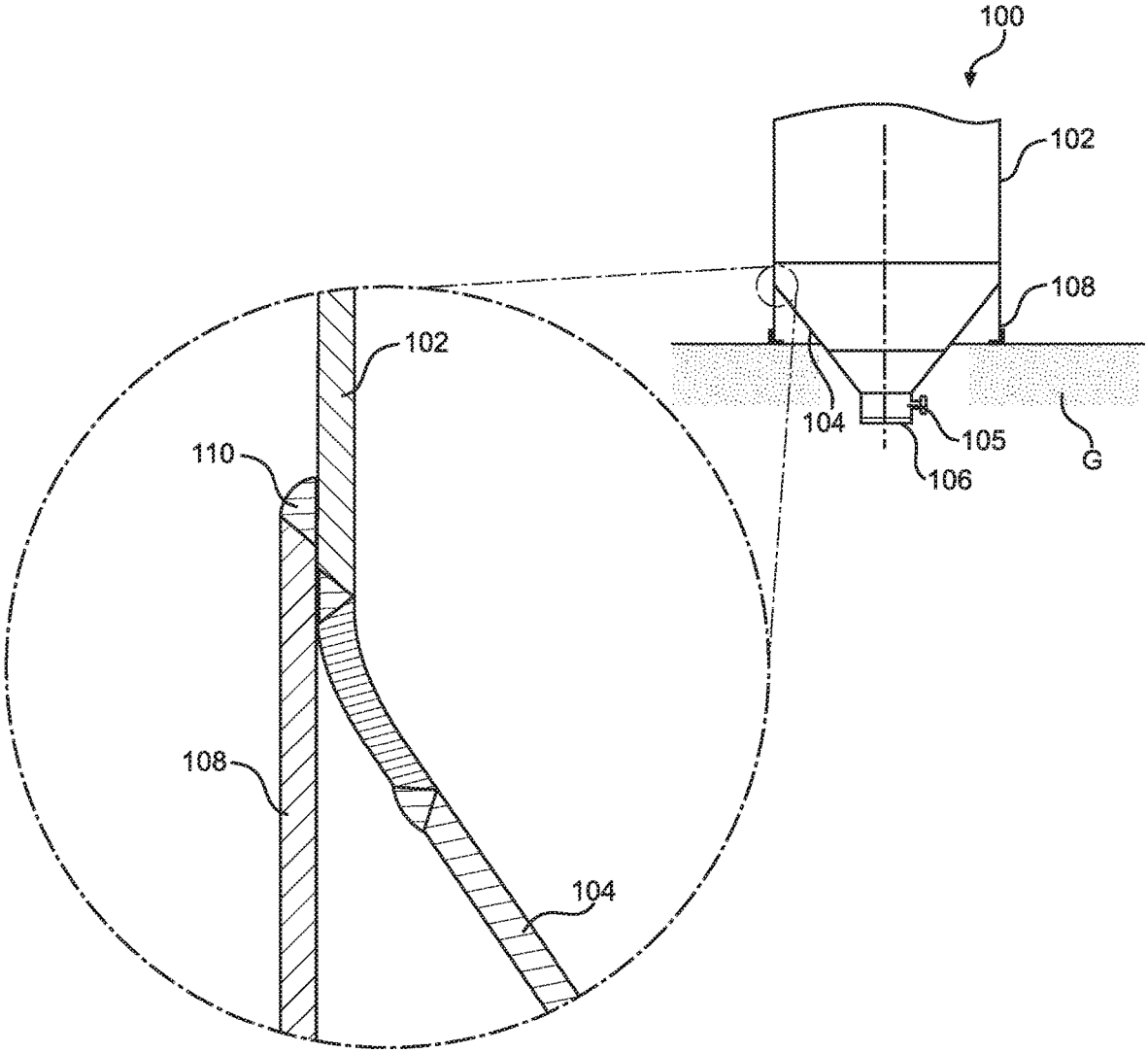
FIG. 1 PRIOR ART
FIG. 1 partially depicts an upper cylindrical portion and a lower frusto-conical portion of a coking drum and support skirt mounted to the coking drum.
Figure 2:
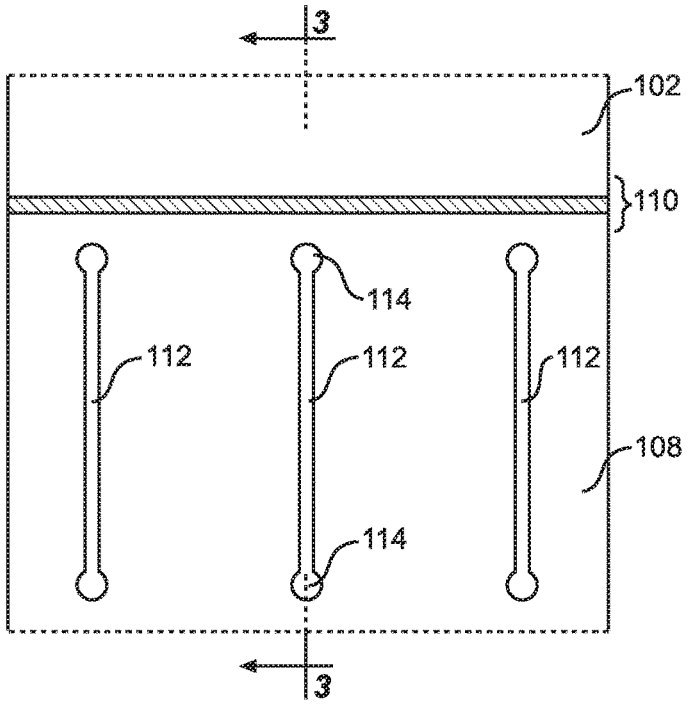
FIG. 2 PRIOR ART
FIG. 2 is a front elevation view of a prior art slotted support skirt mounted to a coking drum.
Figure 3:
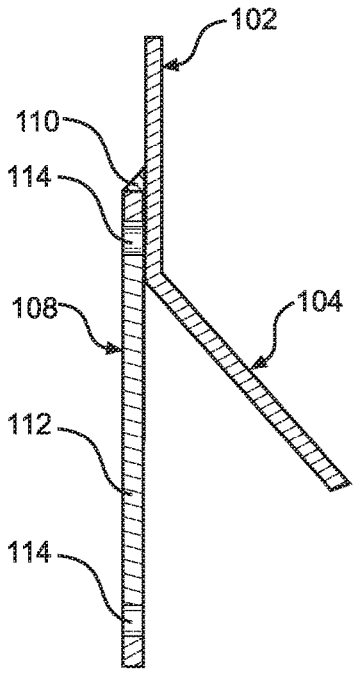
FIG. 3 PRIOR ART
FIG. 3 is a sectional view taken along line 3-3 of FIG. 2.
Figure 9:
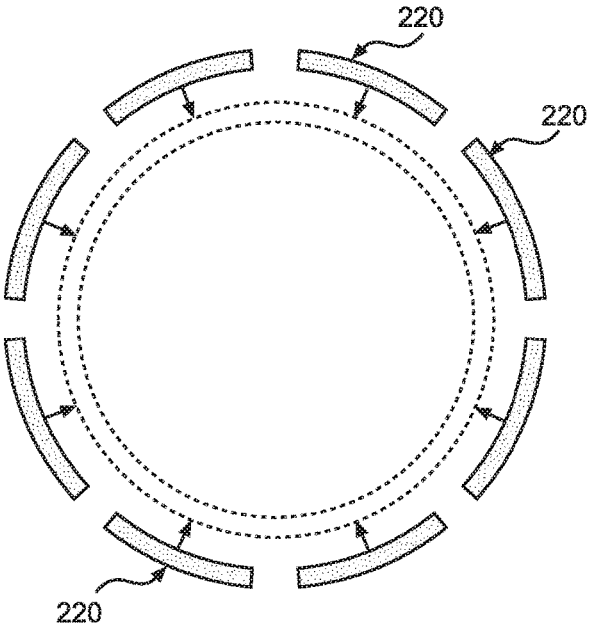
FIG. 9 depicts a plurality of support skirt sections according to an embodiment of the present invention being joined together to form an entire support skirt.
Figure 10:
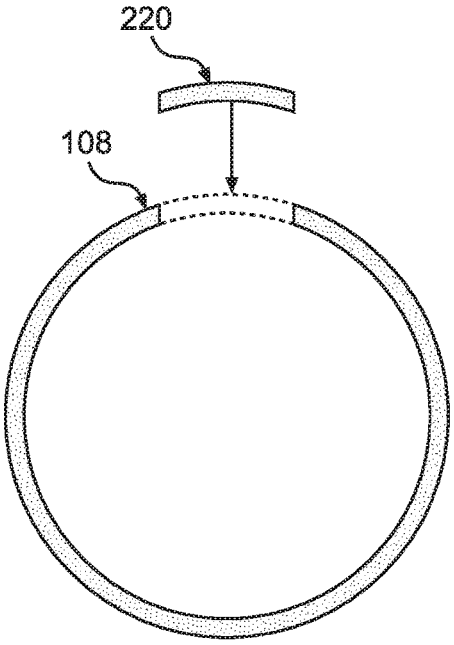
FIG. 10 depicts a support skirt section according to an embodiment of the present invention being retrofitted into an opening formed in an existing (in-situ) support skirt.

Slots 222 may be formed in in-situ or in place support skirts, including those with conventional rectangular slots or slots with keyholes, such as slot 112 shown in FIG. 2. In that instance, slot 112 may be converted to one of the "T" or "I" shaped slots disclosed herein by providing one or more horizontal slot portions in the existing support skirt that are joined to the existing vertical slot. However, in other cases, to simplify the manufacturing process, slots 222 may be formed in a separate flat plate using known machining methods, including cutting using a laser or water jet, which plates are then added to a support skirt. In that case, once the slots 222 have been formed, the plate is then rounded to the desired curvature in order to make the plate suitable for mounting to a coking drum. As shown in FIG. 9, one or more support skirt sections 220 may be joined together at ends thereof to form an entire support skirt. This method may be used, for example, for the initial installation of a new coking drum. Alternatively, as shown in FIG. 10, single support skirt section 220 may be used to replace only a portion of a support skirt 108. This may be useful, for example, during the repair or maintenance of a support skirt installed on an in-situ coking drum.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. An apparatus for improving thermal-mechanical stress resistance in a delayed coking drum having a drum shell, the apparatus comprising:

a support skirt section configured to mount to and to assist in supporting the coking drum above a ground surface;

a joining edge for joining the support skirt section to an exterior portion of the drum shell; and a T-shaped slot formed in the support skirt section.

2. The apparatus of claim 1 wherein the T-shaped slot is formed by a vertical slot portion having a vertical section formed by sides; and a first horizontal slot portion having left and right ends that are separated by a horizontal section, and wherein the horizontal section includes: left and right first horizontal faces joined by shoulders to the sides of the vertical section, and a second horizontal face that is located opposite the first horizontal faces.

3. The apparatus of claim 2 wherein the vertical section of the vertical slot portion is centered between the left and right ends of the first horizontal slot portion.

4. The apparatus of claim 2 wherein at least one of the left and right ends of the first horizontal slot portion is curved.

5. The apparatus of claim 4 wherein both the left and right ends of the first horizontal slot portion are curved.

6. The apparatus of claim 2 wherein an end of the vertical section of the vertical slot portion that is located opposite the first horizontal slot portion is curved.

7. The apparatus of claim 2 wherein both of the left and right first horizontal faces are flat.

8. The apparatus of claim 2 wherein the second horizontal face is flat.

9. The apparatus of claim 2 wherein the second horizontal face is curved.

10. The apparatus of claim 2 further comprising a second horizontal slot joined to the vertical section of the vertical slot opposite the first horizontal slot.

11. The apparatus of claim 2 wherein a vertical height H of the T-shaped slot is greater than a horizontal width W of the slot.

12. The apparatus of claim 1 further comprising a plurality of T-shaped slots spaced laterally across the support skirt section, such that the plurality of T-shaped slots surround at least a portion of the coking drum when the support skirt is mounted to the drum shell.

13. A method for forming a section of a support skirt section that is configured to mount to a drum shell of a coking drum and configured to improve thermal-mechanical stress resistance in the coking drum, the method comprising the steps of:

providing a support skirt section;

forming a T-shaped slot in the support skirt section, the T-shaped slot including a vertical slot portion having a vertical section; and a first horizontal slot portion having left and right ends that are separated by a horizontal section, and wherein the horizontal section includes: left and right first horizontal faces joined by shoulders to sides that form the vertical section of the vertical slot portion, and a second horizontal face that is located opposite the first horizontal faces.

14. The method of claim 13 wherein:

the vertical slot portion and horizontal slot portion are formed in a support skirt section that is a flat plate; and after the vertical slot portion and horizontal slot portion are formed, the flat plate is provided with a desired curvature suitable for mounting the support skirt section to the drum shell.

15. The method of claim 13 further comprising:

providing one or more support skirt sections;

providing a vertical slot portion and horizontal slot portion in each of the one or more support skirt sections;

fixedly joining the one or more support skirt sections together at ends thereof to form a support skirt.

16. The method of claim 13 further comprising the steps of:

providing an in-situ coking drum having an existing support skirt;

replacing at least a portion of the existing support skirt with the support skirt section having the T-shaped slot.

17. A method for improving thermal-mechanical stress resistance in a support skirt mounted to an in-situ coking drum, the method comprising the steps of:

forming a T-shaped slot in a section of the support skirt, the T-shaped slot including a vertical slot portion having a vertical section; and a first horizontal slot portion having left and right ends that are separated by a horizontal section, and wherein the horizontal section includes: left and right first horizontal faces joined by shoulders to sides that form the vertical section of the vertical slot portion, and a second horizontal face that is located opposite the first horizontal faces.

18. The method of claim 17 wherein the support skirt includes an existing vertical slot portion and wherein the T-shaped slot is formed by providing a horizontal slot portion in the support skirt that is joined to the existing vertical slot portion.

19. The method of claim 17 further comprising providing a T-shaped slot having a second horizontal face that curves away from the first horizontal faces.

* * * * *